United States Patent [19]

Henne et al.

[11] Patent Number: 4,909,450

[45] Date of Patent: Mar. 20, 1990

[54] ROLLER MILL

[75] Inventors: Heinrich Henne, Ennigerloh; Ludger Lohnherr, Oelde-Sunninghausen, both of Fed. Rep. of Germany

[73] Assignee: Krupp Polysius AG, Fed. Rep. of Germany

[21] Appl. No.: 194,541

[22] Filed: May 16, 1988

[30] Foreign Application Priority Data

Jun. 4, 1987 [DE] Fed. Rep. of Germany ..... 3718781

[51] Int. Cl.[4] ..... B02C 15/00

[52] U.S. Cl. ..... 241/119; 241/121

[58] Field of Search ..... 241/117–121, 241/101.2, 57

[56] References Cited

U.S. PATENT DOCUMENTS

| | | | |
|---|---|---|---|
| 522,982 | 7/1894 | Gordon | 241/117 X |
| 563,145 | 6/1896 | Duffield et al. | 241/121 X |
| 4,147,308 | 4/1979 | Mikkelsen | 241/117 |

FOREIGN PATENT DOCUMENTS

| | | | |
|---|---|---|---|
| 68681 | 5/1983 | European Pat. Off. . | |
| 430377 | 10/1911 | France | 241/121 |

OTHER PUBLICATIONS

Cement Data Book, vol. 1, 1985, pp. 228–243.

*Primary Examiner*—Mark Rosenbaum
*Attorney, Agent, or Firm*—Learman & McCulloch

[57] ABSTRACT

The invention relates to a roller mill with a mill casing having a vertical axis, a grinding table rotating therein about the casing axis and two grinding rollers which roll on the grinding table and are held stationary by a roller carrier. This roller mill is intended in particular for small throughput capacities, and both grinding rollers are rigidly connected by their spindles to one another and to the roller carrier which passes diametrically through the mill casing and is flexibly and resiliently mounted or supported at its ends. In this way a simple and robust, reliable construction is produced.

13 Claims, 4 Drawing Sheets

ROLLER MILL

The invention relates to a roller mill particularly adapted for operation as a small throughput capacity mill.

BACKGROUND OF THE INVENTION

Roller mills of the aforesaid type are well known in the art in a variety of constructions. As a rule these roller mills are constructed with two or three rollers or pairs of rollers. They are generally used for relatively high throughput capacities, particularly for crushing coal (in coal grinding plant) and cement materials (for the production of cement raw meal or for the fine crushing of cement clinker). In the roller mills designed for these applications the grinding rollers can be resiliently retained individually and independently of one another by one or more roller carriers, as can be seen inter alia from W. Duda "Cement-Data-Book", 3rd Edition, Volume 1, 1985, pages 228 to 243. In these known roller mill constructions relatively great forces occur in the grinding work, and as a result a relatively high expenditure on construction must be incurred for the construction and retention of the individual grinding rollers and for the roller carrier or carriers and the construction and retention of the grinding table.

Starting from the knowledge that on the basis of its crushing work a roller mill is particularly suitable for the preparation of samples (e.g. laboratory samples), for the grinding of coal, coke etc. for small firing and for other small grinding tasks for instance in the chemical industry (outside the cement sector), the object of the invention is to provide a roller mill which with an appropriate relatively small throughput capacity is distinguished by a comparatively simple design but very robust construction which is not very prone to disruption and thus can be produced at relatively low cost.

In EP-A No. 68 681 a roller mill is disclosed in which the grinding rollers are mounted on a common supporting frame and to judge by the drawings the spindles of the grinding roller could be rigidly connected to this common supporting frame, apart from the fact that in this publication nothing detailed is stated with regard to the construction and mounting of the supporting frame, as a result of which this known roller mill clearly does not fulfill the generic concept of the present invention to the fullest extent, and it is also to be stated that the appertaining drawing only shows the roller mill in a vertical sectional view, so that the question remains entirely open as to how large the number of grinding rollers used here is or should be. In any case this known roller mill should quite clearly be placed in the category explained above which is intended for relatively high throughput capacities.

SUMMARY OF THE INVENTION

In the construction of the roller mill according to the invention the two grinding rollers which are aligned coaxially and an appropriately great axial distance apart are rigidly connected by their spindles to one another and thus also rigidly connected to the roller carrier. The grinding power of the grinding rollers against the grinding track of the grinding table can be applied directly from the exterior through the roller carrier which passes diametrically through the mill casing. This roller carrier is mounted at its first end so as to be jointed and sprung on the mill casing and at its opposing second end is led out of the mill casing so as to be sealed and is here supported so as to be vertically adjustable.

This relatively simple construction which operates extremely reliably and is comparatively cheap in terms of costs makes use amongst other things of the knowledge that because of the smaller construction and throughput capacity the reciprocal influence of the two grinding rollers in comparison with the large roller mills mentioned in the introduction can be kept relatively small and the relatively small forces occurring here can be reliably overcome by design, which in large mill units causes numerous problems. In comparison with the roller mills for relatively large throughput capacities which are known in the art the roller mill according to the invention is markedly simplified in spite of its extremely robust construction and its very reliable mode of operation.

The way in which the roller mill according to the invention functions (including feeding and fine material discharge) can correspond in principle to that of the known (large) roller mills: this also applies basically to the rest of the general construction, according to which a static or dynamic air separator can be set up in a manner which is known per se above the actual roller mill.

THE DRAWINGS

The invention will be explained in greater detail below with the aid of the drawings. In these drawings, which have to some extent been kept quite schematic:

DETAILED DESCRIPTION

Figure 1:
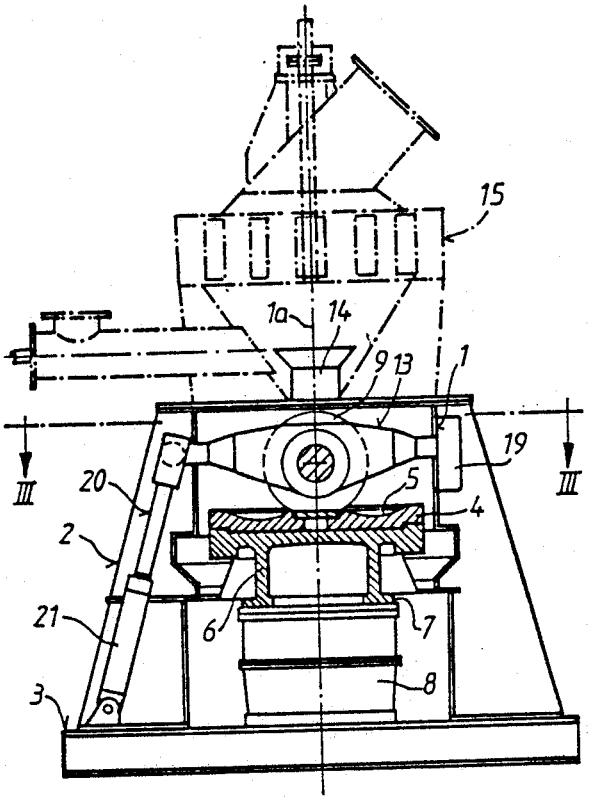
FIG. 1 shows a vertical sectional view of a first embodiment of the roller mill according to the invention.

First of all the general construction of the roller mill according to the invention (also designated as a spring-loaded roller mill) will be explained with the aid of FIGS. 1 and 2.

This roller mill contains a mill casing 1 which is set up in the usual way with a vertical axis 1*a*, and this mill casing 1 can be stiffened on its outside by a type of supporting frame or supporting frame construction 2. The roller mill with its mill casing 1 and supporting frame 2 is firmly set up and anchored on a suitable base or an appropriate bedplate 3.

Inside the mill casing 1 a grinding table 4 is arranged which has a circular grinding track 5 on its upper face in the usual way and is supported by its underside on a driven rotating collar 6 which in turn is fixed (screwed) so as to be fixed against rotation on the upper end of the driven shaft 7 of a mill drive gear 8 which can be driven in a suitable manner by an electric motor (not shown). The grinding table 4 which is aligned substantially horizontally is thus driven in rotary motion during the operation of the roller mill by means of the gear 8 and the collar 6 about the vertical casing axis 1*a*, and the grinding track 5 turn round axially with respect to the casing axis 1*a*.

Two grinding rollers 9, 10 which are constructed in the conventional manner and essentially the same and are adapted on their outer peripheral surface to the cross-section of the grinding track 5 (cf. FIG. 2) roll on the grinding track 5 of the grinding table 4. The two grinding roller 9, 10 are associated with regions of the grinding track 5 which lie diametrically opposite one another.

Furthermore the two grinding rollers 9, 10 are freely rotatably movable about their own axes 11 and 12 respectively and essentially stationary but are retained by a common roller carrier 13 so that they are resiliently movable in the vertical direction with respect to the grinding table 4.

Figure 2:
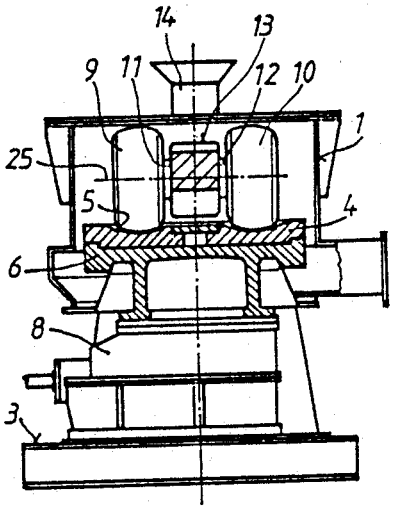
FIG. 2 shows a vertical sectional view of the roller mill which is rotated by about 90° with respect to FIG. 1.

With regard to the general construction of the roller mill and the way in which it operates it should also be added that the feed material for grinding is delivered in the usual way centrally via a feed pipe 14 and finished material for grinding which is sufficiently crushed can be removed over the outer edge of the grinding table, and in addition this roller mill can be constructed—as shown in solid lines—purely as a crushing mill or—as shown by dash-dot lines in FIG. 1—as a roller mill with a (static or dynamic) air separator 15 built directly onto it, this air separator being in pneumatic conveying connection with the outer peripheral region of the grinding table 4, as is known per se.

In this roller mill according to the invention, which is intended above all for relatively small throughput capacities, the two grinding rollers 9, 10 which are aligned coaxially with respect to one another are connected by their spindles 11 and 12 respectively rigidly to one another and also rigidly connected to the roller carrier 13. As can be seen from FIG. 1 and in particular from FIGS. 3 and 4, the roller carrier 13 passes diametrally through the mill casing 1 above the grinding table 4, and has at one, first end 13*a* a construction 16 like a spherical segment with which this first end 13*a* is mounted in a ball joint plain bearing race 17 which is in turn supported by at least one set of springs, preferably several sets of springs 18, in a bearing housing 19 in the manner of a shock absorber. The bearing housing 19 is advantageously build on (e.g. screwed on) to the exterior of the mill casing 1 and is vertically movable to equalise wear. The opposing second end 13*b* of the roller carrier 13 is led out of the mill casing 1 and sealed, is vertically movable and adjustable and is also preferably resiliently supported by a pull rod 20 on the bedplate 3. In this first example a pressure medium cylinder, preferably a hydraulic cylinder 21, which serves both for the vertical adjustability of the second end 13*b* of the roller carrier and as a spring element therefor is associated with the pull rod 20. In goes without saying that the pull rod can also be mechanically adjustable and a conventional mechanical spring arrangement can be associated with it.

Figure 3:
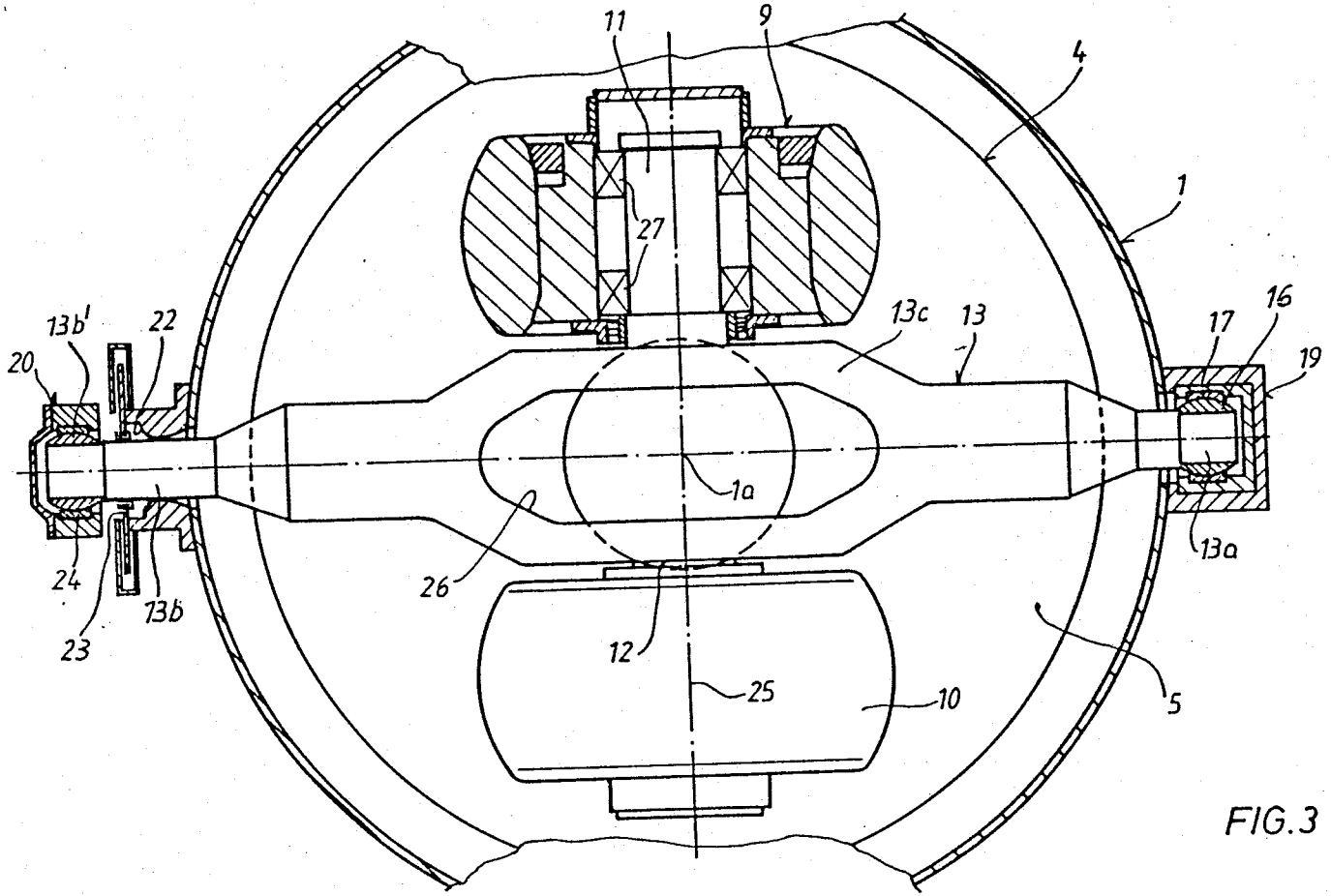
FIG. 3 shows a ground plan view approximately along the section line III—III in FIG. 1 (on an enlarged scale)

As can be seen from FIG. 3, it can be advantageous to lead the second end 13*b* of the roller carrier 13 out of the mill casing 1 through a convex opening 22 so that it is vertically movable. In addition, or alternatively, according to FIG. 4 this second end 13*b* of the roller carrier can be sealed in the region of the casing opening by an elastic seal 23.

Figure 4:
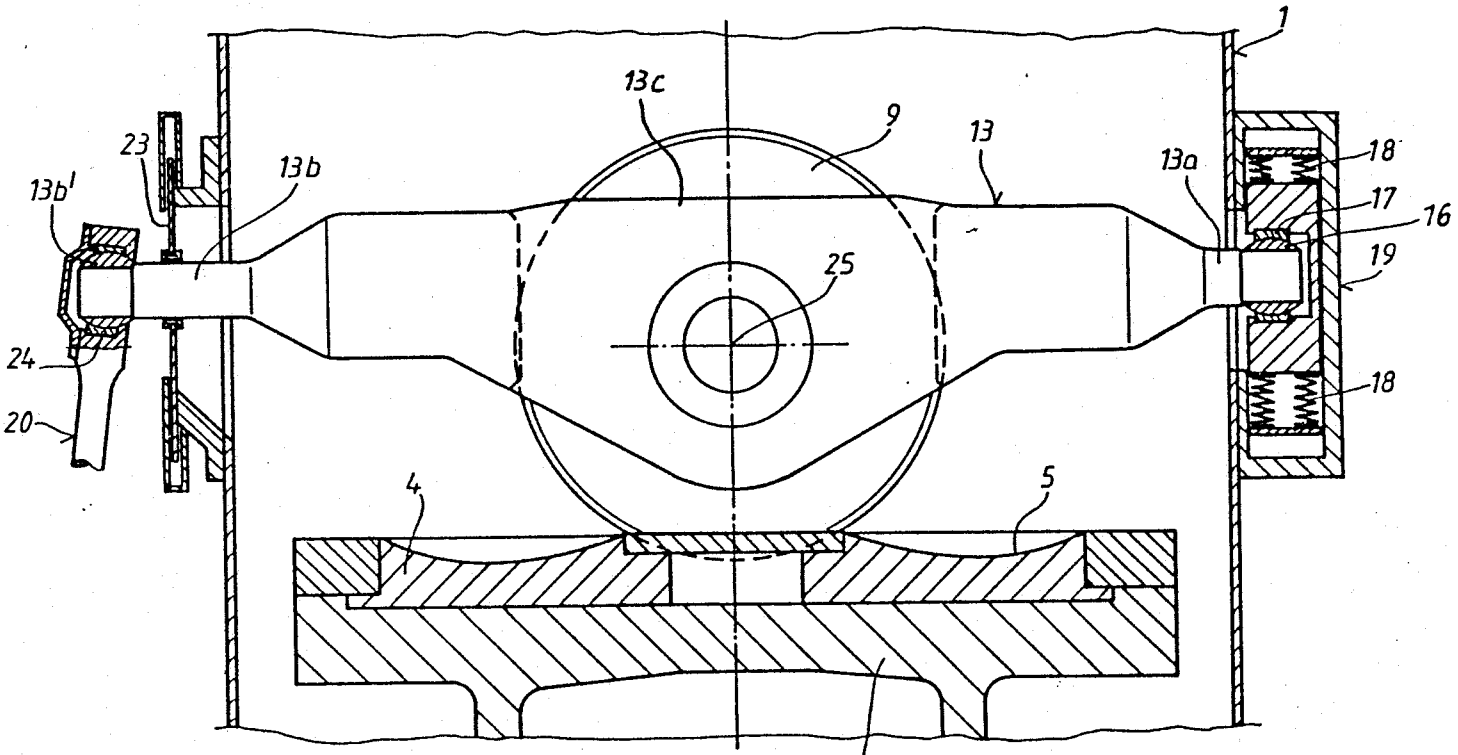
FIG. 4 shows a part of FIG. 1 on an enlarged scale, especially to explain the arrangement of the roller carrier.

The outermost section of the second end 13*b* of the roller carrier is also shaped like a spherical segment (at 13*b*')—as shown in FIGS. 3 and 4—and this outermost section is also mounted in a second ball joint plain bearing race 24 which is provided at the upper end of the pull rod 20.

The roller carrier 13 which is constructed separately in this case is—as can be seen in particular in FIG. 3—arranged so that it extends substantially are right angles to the common (substantially horizontal) geometric axis 25 of the two grinding rollers 9, 10. This grinding roller carrier 13 is constructed in the region of the vertical casing axis 1*a* with a somewhat frame-like central part 13*c* in such a way that a central vertical opening 26 is produced for the material to pass through.

A suitably adapted short, stump-like grinding roller spindle 11, 12 is provided for each grinding roller 9, 10. Both grinding roller spindles 11, 12 are rigidly mounted on the opposing (preferably flattened) outer faces of the frame-like central portion 13*c* of the roller carrier, i.e. they can be firmly flanged or directly cast on there. The material passage 26 formed by the frame-like central part 13*c* offers the advantage that material for grinding which is delivered via the feed pipe 14 can be delivered directly in the centre of the grinding table (and a distributor plate or the like located there).

The two grinding rollers 9, 10 are preferably mounted by means of roller bearings 27 on the appertaining spindle 11, 12, as indicated purely schematically in FIG. 3 in the case of the grinding roller 9. These roller bearings 27 preferably have a long-term grease lubrication with special roller bearing grease. Whereas in the larger-capacity roller mills described in the introduction lubricating oil is used for various reasons (e.g. because of the relatively high price of special roller bearing grease), the relatively small quantity of grease necessary for the grinding rollers 9, 10 makes it possible to use special roller bearing grease, and in this case it is also possible to dispense with the usual confining air seal. Simple relubrication of the roller bearing 27 is easily possible by means of a conventional relubrication bore in the spindle.

Whereas on especially preferred embodiment of the roller mill according to the invention has been explained above with the aid of FIGS. 1 to 4, some particularly simple possible constructions will now be dealt with below with the air of FIGS. 5 and 6 and with reference to FIG. 3. For the sake of simplicity these further embodiments are only shown in very simplified ground plan in FIGS. 5 and 6, and the substantially similar parts are given the same reference numerals as in the preceding example so that it is unnecessary to explain them again.

Figure 5:
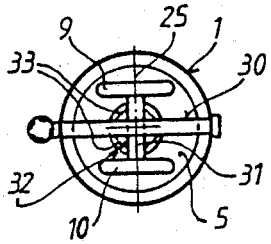
FIGS. 5 and 6 show greatly simplified schematic ground plan views (similar to FIG. 3) of two other embodiments for mounting the grinding rollers.

First of all, FIG. 5 shows only one variant for the construction of the roller carrier 30. In this case too one separately constructed roller carrier 30 which runs at right angles to the geometric grinding roller axis 25 is provided for both grinding rollers 9, 10. In this case (FIG. 5) a continuous common grinding roller spindle 31 is provided for both grinding rollers 9, 10, crosses the roller carrier 30 and is rigidly connected thereto at the crossing point 32, preferably welded or screwed with the aid of additional inserts 33. The two ends of this grinding roller carrier can be constructed and mounted in the manner illustrated and described in particular with the aid of FIGS. 3 and 4.

Figure 6:
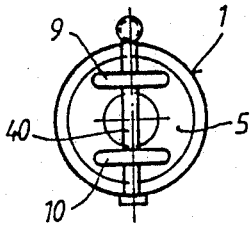

In the example according to FIG. 6 the two grinding rollers 9, 10 roll in the grinding track 5 on the grinding table inside the mill casing 1 in a substantially similar manner to that of the first embodiment. In this case (FIG. 6), however, the two grinding rollers 9, 10 are mounted so as to be freely rotatable on a continuous common grinding roller spindle 40 which at the same time also forms the roller carrier. This combined roller carrier and grinding roller spindle 40 can then in its turn be constructed and mounted or supported at its outer ends in exactly the same manner as was illustrated and described in the first embodiment and particularly with the aid of FIGS. 3 and 4.

Thus in any case in the roller mill according to the invention a sufficient damping of the grinding shocks is ensured (by grinding rollers, roller carrier and the sprung mountings at their ends). In addition it is also possible for the bearing supports for the ends of the roller carrier to be adjusted in the event of an alteration in level due to wear on the periphery of the grinding rollers or the grinding table by means of an appropriate adjustment arrangement, which can be achieved by spindle arrangements or the like.

Figure 7:
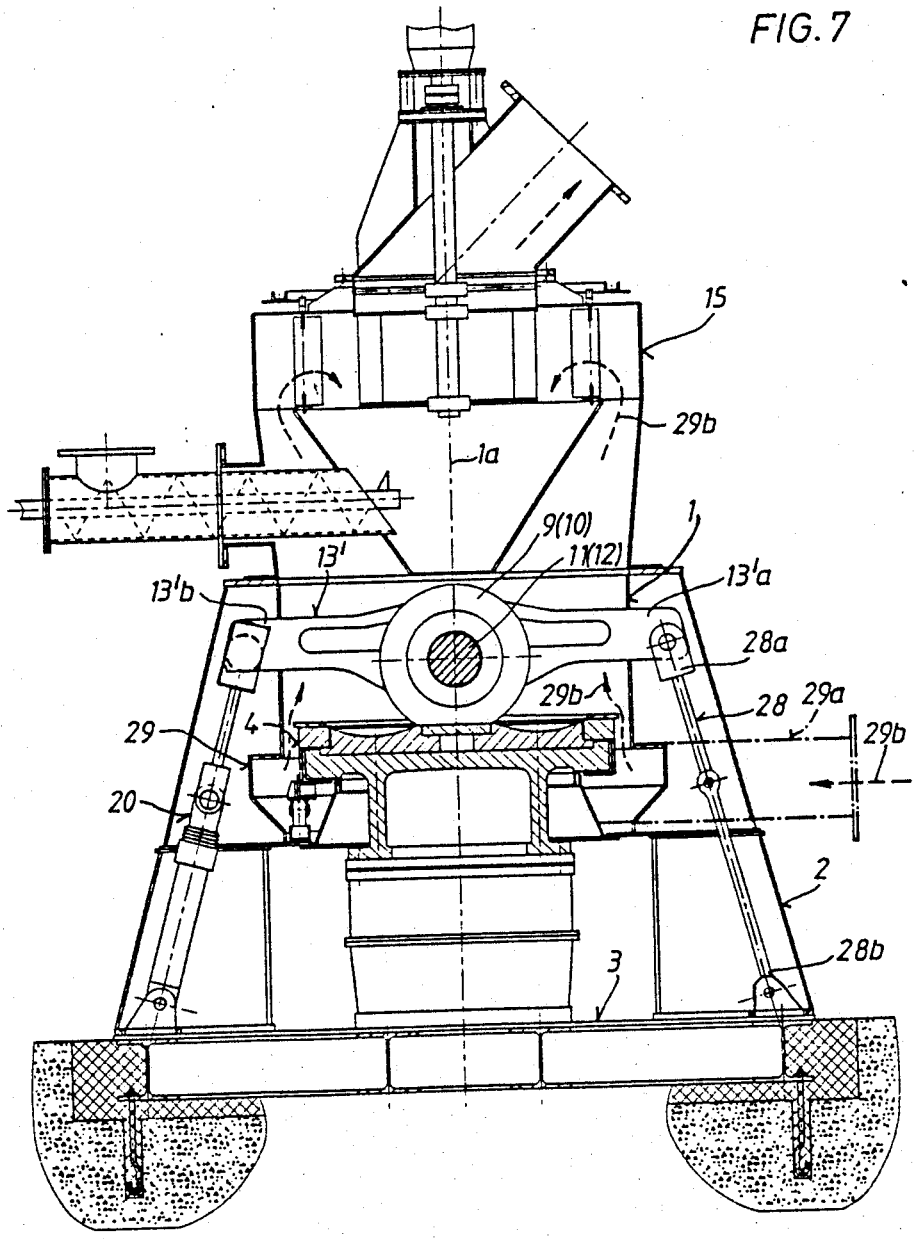
FIG. 7 shows a vertical sectional view of another variant of the construction.

Finally, FIG. 7 shows a further variant of the roller mill described with the aid of FIGS. 1 to 4. Since this variant is similar in construction as regards most of its elements to that already described in detail with the aid of FIGS. 1 to 4, the same parts in this embodiment according to FIG. 7 can be given the same reference numerals, so that they are not described again in detail.

Accordingly the roller mill according to FIG. 7 again has a mill casing 1 with a vertical axis 1*a*, a support frame 2 which is fixed on a bedplate 3, the grinding table 4 which is driven in rotary motion in the same way, grinding rollers 9, 10 which roll on it with spindles 11, 12 rigidly connected to one another and a roller carrier 13' which is also rigidly connected thereto.

This roller carrier 13' is of substantially the same construction as in the first example according to FIGS. 1 to 4, but in the present case is led out of the mill casing 1 at both of its opposing ends 13*a* and 13*b* and sealed. By contrast with the first example, the first end 13'*a* of the roller carrier is flexibly retained on the upper end 28*a* of a simple stay rod 28, the lower end 28*b* of which is flexibly supported on the mill base (bedplate 3). The joints at the upper end 28*a* and the lower end 28*b* of this stay rod 28 can be constructed as simple joints, for example in the form of claw joints or the like with link pins. On the other hand the second end 13'*b* of the roller carrier is again constructed and supported in exactly the same manner as was explained in detail above in particular with the aid of FIGS. 3 and 4, i.e. this second end 13'*b* of the roller carrier is passed through the convex passage 22 out of the mill casing and in the region of this casing passage is reliably sealed by the elastic seal 23. If necessary, such an elastic seal 23 can also be provided on the opposite side of the casing for the first end 13'*a* of the roller carrier to be passed through and sealed.

By means of this variant according to FIG. 7 somewhat larger roller mill constructions can be designed particularly favourably in order to lead the forces from both ends of the roller carrier 13' directly into the base (bedplate 3). Whereas the stay rod 28 can be of substantially rigid construction (possibly somewhat adjustable mechanically), the second end 13'*b* of the roller carrier is again supported by the vertically flexibly movable and adjustable pull rod 20.

In the explanation of the first embodiment reference has already been made with regard to the general construction to the fact that a suitable (static or dynamic) air separator 15 can be built directly onto the mill casing 1. This is also the case in FIG. 7, in which the air separator 15 is shown in solid lines. In this type of roller mill with an air separator built on, it is advantageous to surround the outer periphery of the grinding table 4 with an annular sifting and transport air supply 29 to which an air pipe (29*a*) bringing this sifting and transport air (arrow 29*b*) is connected in a manner which is known per se. The air separator 15 is then in pneumatic conveying connection with the air supply 29 in the peripheral region of the grinding table 4, as is indicated by the broken arrows 29*b*.

What is claimed is:

1. A roller mill adapted for small throughput capacities, said mill comprising:

a mill casing;

a grinding table in said casing;

means for rotating said table about a first, vertical axis in said casing whereby said table revolves in a horizontal plane;

a pair of grinding rollers in said casing overlying said table and in engagement therewith, said rollers being diametrically opposed to one another on opposite sides of said axis;

coaxial spindle means mounting each of said rollers for rotatable movement about a second, horizontal axis so as to roll on said table when said table is rotating;

single carrier means supporting said spindle means and extending diametrally of said table along a third, horizontal axis normal to each of said first and second axis; both of said second and third axes intersecting said first axis; and adjustment means engaged with said carrier means for enabling movement of said carrier means toward and away from said plane and simultaneously corresponding movement of said rollers relative to said table.

2. The roller mill of claim 1 wherein resilient support means forms part of said adjustment means to control said movement of said carrier means and said rollers relative to said table.

3. The roller mill of claim 1 wherein said adjustment means extend externally of said mill casing.

4. The roller mill of claim 1 wherein said carrier means is of frame-like configuration with side frame portions supporting said spindle means and a central open portion through which material to be ground may be fed to said table.

5. The roller mill of claim 1 wherein said carrier means is in the form of a single shaft with spaced portions thereof defining said spindle means.

6. The roller mill of claim 1 wherein the outer periphery of said grinding table is in communication with air supply means for transporting ground material vertically above said grinding table; and material sifting means mounted above said roller mill and in communication therewith to receive ground material therefrom.

7. The roller mill of claim 1 wherein said carrier means is provided with a pair of opposite end portions, one of which is pivotally attached to said casing and the other of which extends through said casing into engagement with said adjustment means, and means for vertically adjusting the pivotal attachment of said one end portion.

8. The roller mill of claim 7 wherein there are a pair of said rollers diametrically opposed to one another on said table with said spindle means coaxially aligned.

9. The roller mill of claim 8 wherein said carrier means is of frame-like configuration with side frame portions supporting said spindle means and a central open portion through which material to be ground may be fed to said table.

10. The roller mill of claim 8 wherein said carrier means is in the form of a single shaft with spaced portions thereof. defining said spindle means.

11. The roller mill of claim 7 wherein said one end portion of said carrier is provided with a spherical segment received in bearing means including race means and spring means pressing said race means against said spherical segment, said bearing means being mounted on said casing.

12. The roller means of claim 11 wherein said other end portion extends through a convex opening in said casing, and resilient sealing means acting around said other end portion to seal said opening.

13. The roller means of claim 7 wherein said other end portion extends through a convex opening in said casing, and resilient sealing means acting around said other end portion to seal said opening.

* * * * *

UNITED STATES PATENT AND TRADEMARK OFFICE

CERTIFICATE OF CORRECTION

PATENT NO. : 4,909,450

DATED : March 20, 1990

INVENTOR(S) : Henne et al

It is certified that error appears in the above-identified patent and that said Letters Patent is hereby corrected as shown below:

In lines 8 and 9 of the ABSTRACT, change "diametrically" to -- diametrally --;

In column 3, line 2, change "turn" to -- turns --;

In column 3, line 9, change "roller" to -- rollers --;

In column 3, line 46, change "build" to -- built --;

In column 3, line 56, change "In" to -- It --;

In column 4, line 7, change "are" to --at --;

In column 4, line 41, change "on" to -- an --;

In column 4, line 45, change "air" to -- aid --;

In column 7, line 6, omit the period (first occurance).

Signed and Sealed this

Seventh Day of May, 1991

*Attest:*

*Attesting Officer*

HARRY F. MANBECK, JR.

*Commissioner of Patents and Trademarks*